US010653289B2

(12) United States Patent
Ireland et al.

(10) Patent No.: US 10,653,289 B2
(45) Date of Patent: May 19, 2020

(54) ADAPTING DISHWASHER OPERATION TO EXTERNAL FACTORS

(71) Applicant: Whirlpool Corporation, Benton Harbor, MI (US)

(72) Inventors: Vincent A. Ireland, Saint Joseph, MI (US); Traci L. Kachorek, Saint Joseph, MI (US); Brooke L. Lau, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 240 days.

(21) Appl. No.: 15/677,301

(22) Filed: Aug. 15, 2017

(65) Prior Publication Data

US 2017/0340185 A1 Nov. 30, 2017

Related U.S. Application Data

(63) Continuation of application No. 12/774,749, filed on May 6, 2010, now abandoned.

(51) Int. Cl.
*A47L 15/00* (2006.01)
*A47L 15/46* (2006.01)

(52) U.S. Cl.
CPC ..... *A47L 15/0021* (2013.01); *A47L 2301/04* (2013.01); *A47L 2501/26* (2013.01); *A47L 2501/30* (2013.01)

(58) Field of Classification Search
CPC ..... A47L 15/0021; A47L 2301/04; A47L 2501/26; A47L 2501/30
See application file for complete search history.

(56) References Cited

U.S. PATENT DOCUMENTS 5,698,826 A * 12/1997 Cracraft ..... H01H 13/70 200/310
5,960,804 A 10/1999 Cooper et al.
6,210,600 B1 * 4/2001 Zhou ..... C11D 3/3769 134/25.2
6,327,730 B1 * 12/2001 Corbett ..... D06F 33/02 134/18
6,425,156 B1 7/2002 Knopp et al.
6,463,939 B1 10/2002 Kornaat et al.
6,648,981 B2 11/2003 McIntyre et al.
6,859,930 B2 2/2005 Anderson
7,110,836 B2 9/2006 Sturm et al.
7,111,292 B2 9/2006 Bonnett et al.
7,445,014 B2 11/2008 Sakane et al.
(Continued)

OTHER PUBLICATIONS

GE Profile Dishwasher Technical Service Guide dated Feb. 2006 (Year: 2006).*

(Continued)

*Primary Examiner* — Douglas Lee
(74) *Attorney, Agent, or Firm* — Diederiks & Whitelaw, PLC.

(57) ABSTRACT

A method of operating a dishwasher includes receiving a user-input signal indicative of a hidden operating mode, selecting the hidden operating mode of a dishwasher based on the user-input signal, accessing a plurality of pre-programmed dishwashing cycles associated with the selected hidden operating mode, and operating the dishwasher in accordance with one of the plurality of pre-programmed dishwashing cycles.

20 Claims, 4 Drawing Sheets

(56) References Cited

U.S. PATENT DOCUMENTS

| | | | | |
|---|---|---|---|---|
| 2006/0089295 | A1* | 4/2006 | Boehme | C11D 1/72 510/521 |
| 2006/0284766 | A1* | 12/2006 | Gruchala | G01S 19/14 342/357.52 |
| 2007/0157637 | A1 | 7/2007 | Ferragut, II et al. | |
| 2007/0251546 | A1 | 11/2007 | Choi | |
| 2008/0235614 | A1 | 9/2008 | Ricklefs et al. | |
| 2008/0264448 | A1* | 10/2008 | Berends | A47L 15/0049 134/18 |
| 2008/0276965 | A1 | 11/2008 | Aykroyd et al. | |
| 2008/0283091 | A1 | 11/2008 | Steiner et al. | |

OTHER PUBLICATIONS

The ASKO D5233 Operating Instructions Dishwasher (https://755boylstonstreet.com/s/ASKO-Use-and-Care-Guide-D5233.pdf) available Jan. 24, 2009 (Year: 2009).*

Google search printout showing availability date for ASKO D5233 Operating instructions as Jan. 24, 2009 (Year: 2019).*

Miele Operating Instructions Inspira Series G 1150, G 2140, Flamante G 2150.

Archived Web Page from Kitchen.ManualsOnLine.com dated Jan. 15, 2009.

GE Consumer & Industrial Technical Service Guise GE Profile Dishwasher dated Feb. 2006 (Obtained from http://thisoldappliance.com/library/ge_dw_techsheet.pdf).

* cited by examiner

ADAPTING DISHWASHER OPERATION TO EXTERNAL FACTORS

CROSS-REFERENCE TO RELATED APPLICATIONS

The present application represents a continuation application of U.S. patent application Ser. No. 12/774,749 entitled "ADAPTING DISHWASHER OPERATION TO EXTERNAL FACTORS" filed May 6, 2010, currently pending.

TECHNICAL FIELD

The present disclosure relates generally to a dishwashing machine and more particularly to a mechanism and method of adapting the operation of dishwasher to conditions related to the home of the user.

BACKGROUND

A dishwashing machine is a domestic appliance into which dishes and other cooking and eating wares (e.g., plates, bowls, glasses, flatware, pots, pans, bowls, and etcetera) are placed to be washed. Dishwashers are designed to perform certain tests under controlled conditions. The user's home does not always match the test conditions, which can result in degraded dishwasher performance.

SUMMARY

According to one aspect, a method of operating a dishwasher is disclosed. The method includes receiving a user-input signal indicative of a hidden operating mode, selecting the hidden operating mode of a dishwasher based on the user-input signal, accessing a plurality of pre-programmed dishwashing cycles associated with the selected hidden operating mode, and operating the dishwasher in accordance with one of the plurality of pre-programmed dishwashing cycles. In some embodiments, the user-input signal may be indicative of a sequence of user inputs received via a user interface panel.

In some embodiments, the method may also include indicating the selected hidden operating mode on an external panel of the dishwasher. In some embodiments, indicating the selected hidden operating mode include activating a number of light emitting diodes in a customized sequence indicative of the selected hidden operating mode. Additionally, in some embodiments, the plurality of pre-programmed dishwashing cycles associated with the selected hidden operating mode may be optimized to specific environmental conditions.

In some embodiments, the method may include selecting the factory-default operating mode based on a second user-input signal, and accessing a plurality of pre-programmed dishwashing cycles associated with the factory-default operating mode.

According to another aspect, the method includes initiating a mode selection sub-routine based on a first user-input signal, receiving a second user-input signal indicative of a hidden operating mode, selecting the hidden operating mode based on the second user-input signal, and operating the dishwasher in accordance with the selected hidden operating mode. In some embodiments, the method may include selecting a plurality of pre-programmed dishwashing cycles associated with the selected hidden operating mode.

In some embodiments, initiating the mode selection sub-routine may include indicating the activation of the sub-routine on an external panel of the dishwasher. In some embodiments, the method may include deactivating the mode selection sub-routine when the second user-input signal is not received in a predefined period of time.

According to another aspect, a dishwasher is disclosed. The dishwasher includes a washing chamber, a number of dish racks positioned in the washing chamber, a pump operable to circulate fluid onto the number of dish racks, a user interface operable to receive user input and generate an electrical output signal indicative thereof, and an electronic controller electrically coupled to the pump and the user interface. The controller includes a processor and a memory device electrically coupled to the processor. The memory device has stored therein a plurality of instructions which, when executed by the processor, cause the processor to activate a hidden operating mode of the dishwasher based on the electrical output signal generated by the user interface, and operate the dishwasher in accordance with the hidden operating mode.

In some embodiments, the user interface may include a number of control switches electrically coupled to the electronic controller. The number of control switches may be operable to generate electrical output signals indicative of a sequence of user inputs. The plurality of instructions, when executed by the processor, may further cause the processor to receive the electrical output signals and select the hidden operating mode corresponding to the sequence of user inputs. Additionally, in some embodiments, each control switch of the number of control switches may be coupled to a control button located on the user interface.

In some embodiments, the plurality of instructions, when executed by the processor, may further cause the processor to receive the electrical output signals generated by the control switches and select a factory-default operating mode corresponding to a second sequence of user inputs, and operate the dishwasher in accordance with the factory-default operating mode.

In some embodiments, the user interface may include a number of light emitting diodes electrically coupled to the processor. The plurality of instructions, when executed by the processor, may further cause the processor to activate the light emitting diodes in a sequence indicative of the hidden operating mode.

BRIEF DESCRIPTION OF THE DRAWINGS

The detailed description particularly refers to the following figures, in which.

DETAILED DESCRIPTION OF THE DRAWINGS

Figure 1:
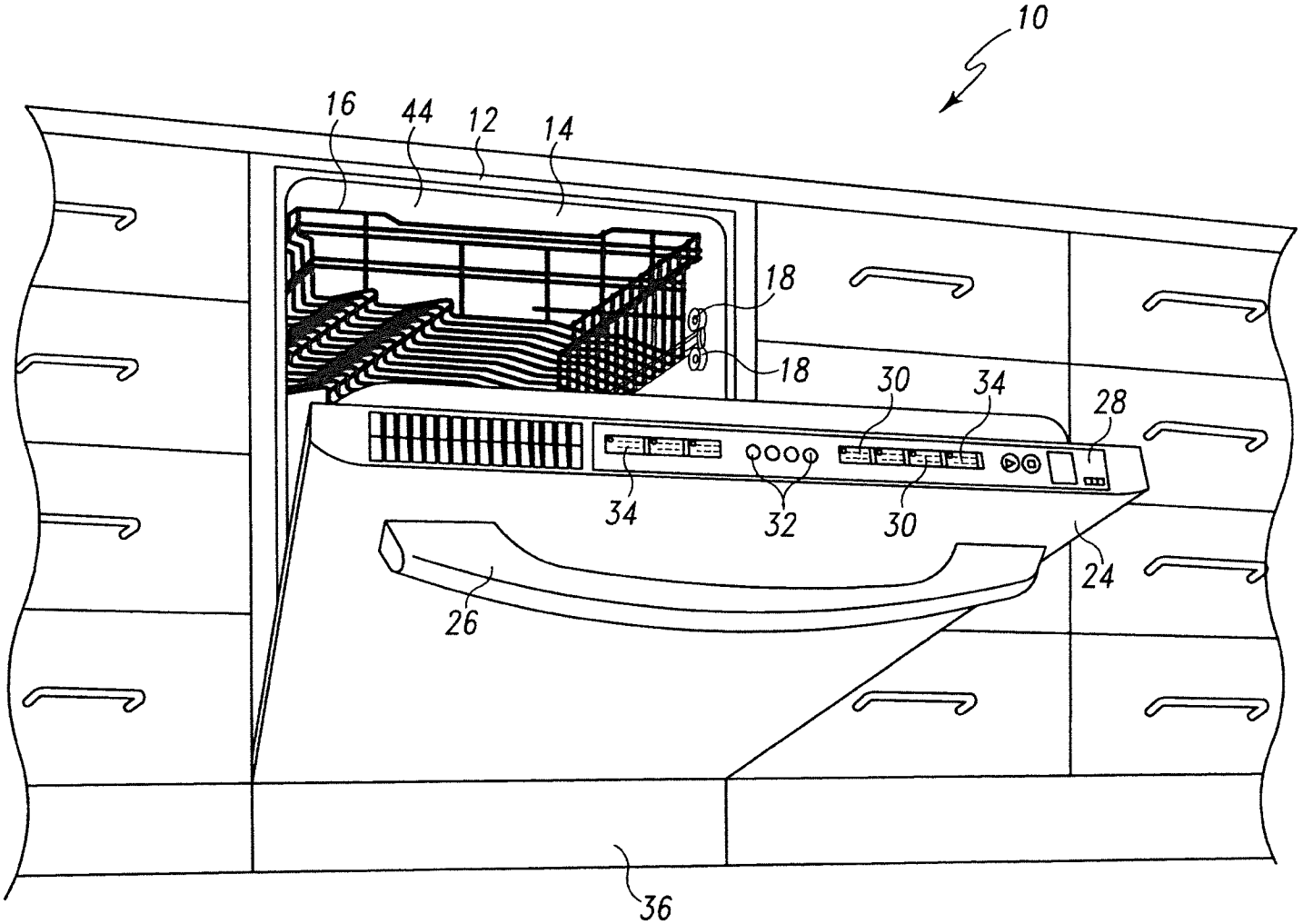
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

The present disclosure relates to a dishwashing machine including a number of hidden operating modes. Each of the hidden operating modes have a plurality of customized, pre-programmed dishwashing cycles. By use of the term "dishwashing cycle," it is meant the operation of a dishwashing machine upon a set of soiled wares that produces a set of cleaned wares, starting with user activation, then proceeding continuously without the need for user intervention, and including at least one washing stage and at least one rinsing stage. A washing stage involves the application of wash chemistry, typically water and detergent, to remove soils from the wares. A rinsing stage that involves the application of rinse chemistry, typically water and rinse aid, to remove the wash chemistry and prepare the wares for drying. A dishwashing cycle may optionally include other stages, such as a drying stage in which heat is applied after wash or a rinsing stage. A dishwashing cycle may be interrupted by a user, such as by opening a door of the dishwasher, thereby causing the dishwashing cycle to pause until the door is closed. However, without such user intervention, the dishwashing cycle will proceed through its associated stages.

The term "hidden operating mode" is defined herein as a control routine for the dishwasher that is invoked by a user pressing a control button or buttons in a specified manner or order to cause the dishwasher to perform a function other than the labeled function of the control button or buttons. For example, the dishwasher may be configured to perform a normal dishwashing cycle when the "Normal Wash" control button is pressed once. To invoke a hidden operating mode, the user may be required to, for example, press and hold the control button "Normal Wash" for more than thirty seconds. In response, the dishwasher does not perform the function indicated by the label (i.e, the normal dishwashing cycle) but instead activates the hidden operating mode. Similarly, a hidden operating mode might be invoked by the user pressing a specific sequence of buttons, such as, for example, simultaneously pressing the "Normal Wash" and "Heavy Duty Wash" buttons and then immediately pressing the "Light Wash" button. In response, the dishwasher activates the hidden operating mode rather than performing the functions indicated by the labels.

Each hidden operating mode includes a plurality of customized, pre-programmed dishwashing cycles. Each of the dishwashing cycles have operational parameters that are optimized to address specific environmental conditions, such as, for example, hard water in the user's home or the presence of cold water in the water source line. Thus, in a "Hard Water" hidden operating mode, each of the dishwashing cycles may have lower operating temperatures and/or longer dishwashing cycle times. Some hidden operating modes may also have dishwashing cycles optimized for the use of detergent tablets, detergent gels, or various types of rinse aid.

A hidden operating mode is therefore distinct from, and in contrast to, a factory-default operating mode that controls the operation of the dishwashing machine from the time of purchase. The plurality of dishwashing cycles associated with the factory-default operating mode have operational parameters that are optimized to satisfy government standards for dishwashing machine performance under controlled conditions rather than being customized to address specific environmental conditions associated with the user.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1; although a lower dish rack is also included in the dishwasher 10. A number of roller assemblies 18 are positioned between the dish racks 16 and the tub 12. The roller assemblies 18 allow the dish racks 16 to extend from and retract into the tub 12, thereby facilitating the loading and unloading of the dish racks 16.

A door 24 is hinged to the lower front edge of the tub 12. The door 24 permits user access to the tub 12 to load and unload the dishwasher 10. The door 24 also seals the front of the dishwasher 10 during a dishwashing cycle. A handle 26 is included on the door 24. The user may use the handle 26 to unlatch and open the door 24 such that the user may access the washing chamber 14.

A control panel 28 is located at the top of the door 24. The control panel 28 includes a number of controls 30, such as buttons and knobs, and a number of light emitting diodes 32 that are used to control the operation of the dishwasher 10. Each of the controls 30 is coupled to a control switch (not shown) operable to generate an electrical output signal when the user presses the corresponding control 30. A label 34 is associated with each of the controls 30 and indicates to the user the function of the dishwasher 10 that will be activated when the control 30 is pressed. Each of the controls 30 may be embodied as a physical switch, a touch sensor, a knob, or other appropriate user input mechanism.

A machine compartment 36 is located below the tub 12. The machine compartment 36 is sealed from the tub 12. In other words, unlike the tub 12, which is filled with fluid and exposed to spray during the dishwashing cycle, the machine compartment 36 does not fill with fluid and is not exposed to spray during the operation of the dishwasher 10. The machine compartment 36 houses components such as the dishwasher's water pump(s) and valve(s), along with the associated wiring and plumbing. It should be noted that, although FIG. 1 depicts a dishwasher 10 installed in a kitchen cabinet, portable dishwashers, which may be removably connected to a faucet, are also contemplated.

Figure 2:
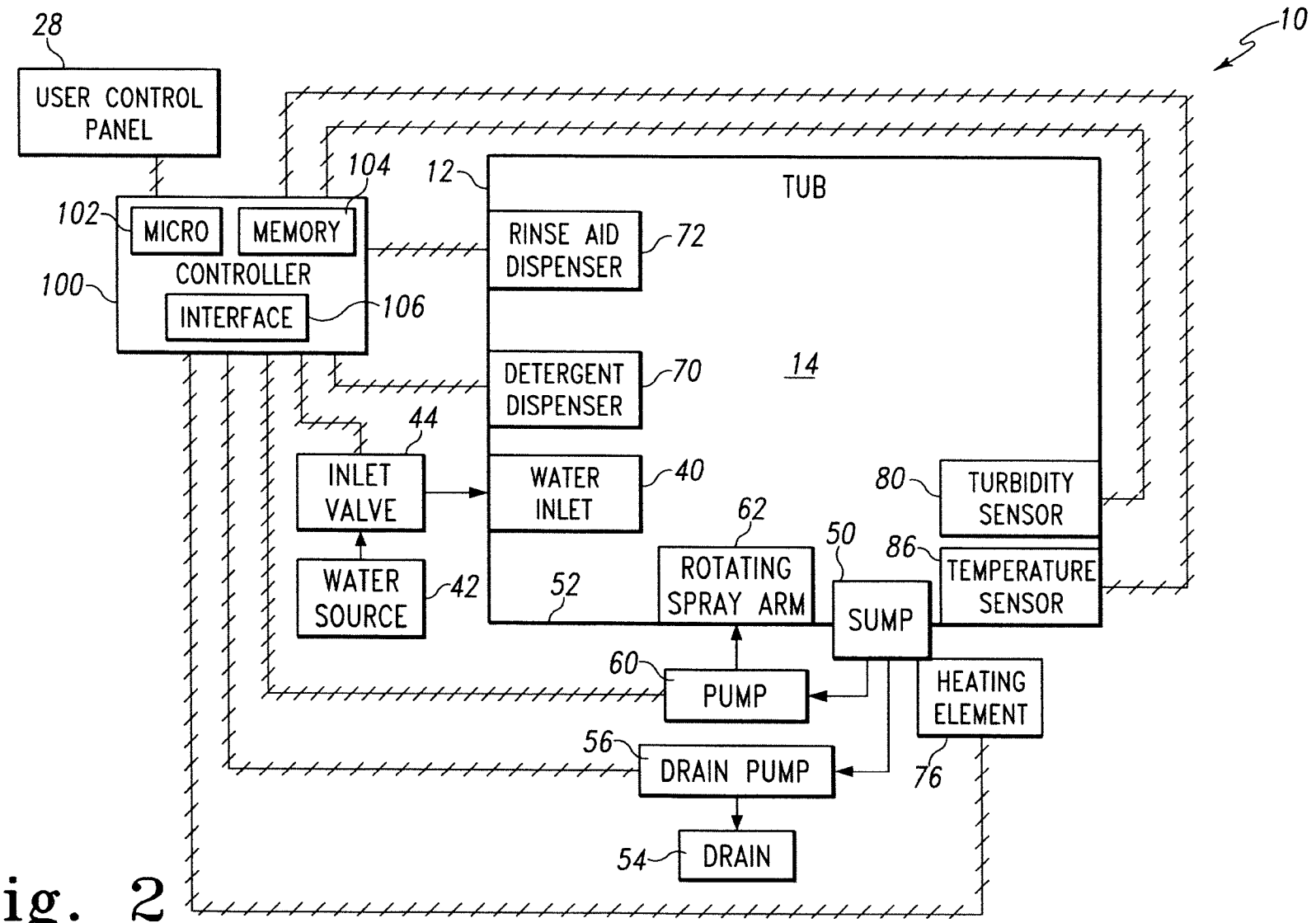
FIG. 2 is a simplified block diagram of one illustrative embodiment of a control system for the dishwashing machine of FIG. 1.

Referring now to FIG. 2, the dishwasher 10 is shown in a simplified block diagram. A sidewall of the tub 12 includes a water inlet 40. The water inlet 40 directs water received from an external water source 42 (e.g., house water supply, kitchen faucet, etcetera) into the washing chamber 14. A water inlet valve 44 positioned between the external water source 42 and the water inlet 40 may be selectively opened or closed to control the flow of water through the water inlet 40. In some embodiments, the water inlet valve 44 may be an electromechanical valve, such as a solenoid-controlled valve, which opens and closes in response to a control signal.

The dishwasher 10 further includes a sump 50 which is formed (e.g., stamped) into a bottom wall 52 of the tub 12. In particular, the sump 50 defines a reservoir that extends downwardly in a direction away from the washing chamber 14. The bottom wall 52 of the tub 12 is shaped such that wash chemistry or rinse chemistry is directed into the sump 50. The sump 50 is connected to an external drain 54 (e.g., house sewer line, kitchen sink, etcetera). A drain pump 56 is positioned between the sump 50 and the external drain 54.

A control signal may selectively energize the drain pump 56 to drain fluids from the sump 50 or de-energize (turn off) the drain pump 56 to retain fluids in the sump 50. In other embodiments, an electromechanical valve, such as a solenoid-controlled valve, that opens and closes in response to a control signal may be used in place of drain pump 56.

A wash pump 60 located in the machine compartment 36 is operable to circulate fluids in the sump 50 onto the dish racks 16 (not shown in FIG. 2). The wash pump 60 is fluidly coupled to a rotating spray arm 62. The spray arm 62 is configured to spray water and/or wash chemistry onto the dish racks 16 (and hence any wares positioned thereon). It should also be appreciated that the dishwashing machine 10 may include other spray arms or spray nozzles positioned at various locations in the tub 12.

The dishwasher 10 includes a detergent dispenser 70 that operates to introduce a detergent, typically in either powder, gel, or tablet form, into the washing chamber 14. The introduced detergent mixes with water in the washing chamber 14 to form a wash chemistry which is applied to aid in the removal of soils from wares during a washing stage of a wash cycle. The detergent dispenser 70 may be located on the surface of the door 24 that faces the washing chamber 14, such that a user may easily refill the detergent dispenser 70 with detergent when the door 24 is opened between dishwashing cycles. In some embodiments, the detergent dispenser 70 may include an electromechanical valve, such as a solenoid-controlled valve, which opens and/or closes in response to a control signal.

The dishwasher 10 also includes a rinse aid dispenser 72 that operates to introduce a rinse aid, typically in either liquid or gel form, into the washing chamber 14. A "rinse aid" may include a surface acting agent (also known as a surfactant), one or more sanitizing chemicals (such as bleach, for example), or both, and may contain other chemistries. A rinse aid may be a single mixture or may be stored as two or more separate components until introduction into the washing chamber 14. In some embodiments, the rinse aid dispenser 72 may include an electromechanical valve, such as a solenoid-controlled valve, which opens and/or closes in response to a control signal, thereby introducing a metered amount of rinse aid into the washing chamber 14.

Upon introduction, the rinse aid mixes with fluid in the washing chamber 14 to form a rinse chemistry that assists in rinsing the wash chemistry from the wares during a rinsing stage. Applying the rinse chemistry to the wares also improves the drying performance of dishwasher 10 and assists in sanitizing the wares during the drying stage of the dishwashing cycle.

An electric heating element 76 is positioned adjacent to the sump 50 and is configured to heat fluid in the sump 50. During a drying stage of the dishwashing cycle when fluid is not being circulated in the washing chamber 14, the electric heating element 76 is configured to increase the temperature in the washing chamber 14 to dry the wares positioned therein. It will be appreciated that in other embodiments the electric heating element 76 may be integrated into the sump 50 or may be embodied as one or more electric heating elements.

A turbidity sensor 80 is positioned in or adjacent to the washing chamber 14 to monitor the turbidity of fluid in the washing chamber 14. As embodied in FIG. 2, the turbidity sensor 80 is an optical water indicator sensor that provides an indication of fluid clarity at any point during the dishwashing cycle and generates an electrical output signal indicative of the turbidity level of the fluid. The output signal is proportionate to the amount of soil, detergent, or rinse aid present in fluid in the washing chamber 14. As the amount of soil, detergent, or rinse aid increases, the output signal increases by a proportionate amount.

A temperature sensor 86 may be optionally positioned in or adjacent to the washing chamber 14 to measure the temperature of fluid in the washing chamber 14. The temperature sensor 86 is configured to take a temperature measurement of the fluid in the washing chamber 14 and generate an electrical output signal indicative of that measurement.

The dishwasher 10 also includes an electronic control unit (ECU) or "electronic controller" 100. The electronic controller 100 may be positioned in the door 24 or the machine compartment 36 of the dishwasher 10. The electronic controller 100 is, in essence, the master computer responsible for interpreting electrical signals sent by sensors associated with the dishwasher 10 and for activating or energizing electronically-controlled components associated with the dishwasher 10. For example, the electronic controller 100 is configured to control operation of the various components of the dishwasher 10, including the wash pump 60, rinse aid dispenser 72, and inlet valve 44. The electronic controller 100 also monitors various signals from the control panel 28, the turbidity sensor 80, and any other sensor. The electronic controller 100 also determines when various operations of the dishwasher 10 should be performed. As will be described in more detail below with reference to FIGS. 3 and 4, the electronic controller 100 is operable to control the components of the dishwasher 10 such that when the user selects a hidden operating mode, the dishwasher 10 activates the selected operating mode and operates according to the selected operating mode.

To do so, the electronic controller 100 includes a number of electronic components commonly associated with electronic units utilized in the control of electromechanical systems. For example, the electronic controller 100 may include, amongst other components customarily included in such devices, a processor such as a microprocessor 102 and a memory device 104 such as a programmable read-only memory device ("PROM") including erasable PROM's (EPROM's or EEPROM's). The memory device 104 is provided to store, amongst other things, instructions in the form of, for example, a software routine (or routines) which, when executed by the microprocessor 102, allows the electronic controller 100 to control operation of the dishwasher 10.

The electronic controller 100 also includes an analog interface circuit 106. The analog interface circuit 106 converts the output signals from various sensors (e.g., the turbidity sensor 80) into signals which are suitable for presentation to an input of the microprocessor 102. In particular, the analog interface circuit 106, by use of an analog-to-digital (A/D) converter (not shown) or the like, converts the analog signals generated by the sensors into digital signals for use by the microprocessor 102. It should be appreciated that the A/D converter may be embodied as a discrete device or number of devices, or may be integrated into the microprocessor 102. It should also be appreciated that if any one or more of the sensors associated with the dishwasher 10 generate a digital output signal, the analog interface circuit 106 may be bypassed.

Similarly, the analog interface circuit 106 converts signals from the microprocessor 102 into output signals which are suitable for presentation to the electrically-controlled components associated with the dishwasher 10 (e.g., the rinse aid dispenser 72). In particular, the analog interface circuit 106, by use of a digital-to-analog (D/A) converter (not shown) or the like, converts the digital signals generated by the microprocessor 102 into analog signals for use by the electronically-controlled components associated with the dishwasher 10. It should be appreciated that, similar to the A/D converter described above, the D/A converter may be embodied as a discrete device or number of devices, or may be integrated into the microprocessor 102. It should also be appreciated that if any one or more of the electronically-controlled components associated with the dishwasher 10 operate on a digital input signal, the analog interface circuit 106 may be bypassed.

Thus, the electronic controller 100 may control the operation of the dishwasher 10 in accordance with the selected dishwashing cycle. In particular, the electronic controller 100 executes a routine including, amongst other things, a control scheme in which the electronic controller 100 monitors the outputs of the sensors associated with the dishwasher 10 to control the inputs to the electronically-controlled components associated therewith. To do so, the electronic controller 100 communicates with the sensors associated with the dishwasher 10 to determine, amongst numerous other things, the temperature of fluid in the washing chamber 14 and the turbidity of fluid in the washing chamber 14. Armed with this data, the electronic controller 100 performs numerous calculations, either continuously or intermittently, including looking up values in preprogrammed tables, in order to execute algorithms to perform such functions as controlling the drain pump 56 to retain fluid in the sump 50, determining when operate the detergent dispenser 70 or the rinse aid dispenser 72 to release chemistry into the tub 12, controlling the wash pump 60 to apply fluid to the wares positioned in the dishwasher 10, and so on.

As will be appreciated by those of the skill in the art, the dishwasher 10 may include elements other than those shown and described above, such as, by way of example, an additional electric heating element to assist in drying the wares or a filter to remove particulates from the re-circulated wash chemistry or rinse chemistry. The dishwasher 10 may also include a variety of other sensors that monitor conditions within the washing chamber 14, the sump 50, and/or other components of the dishwasher 10. It should also be appreciated that the location of many components (i.e., in the washing chamber 14, in the machine compartment 36, in or on the door 24) may also be altered.

Figure 3:
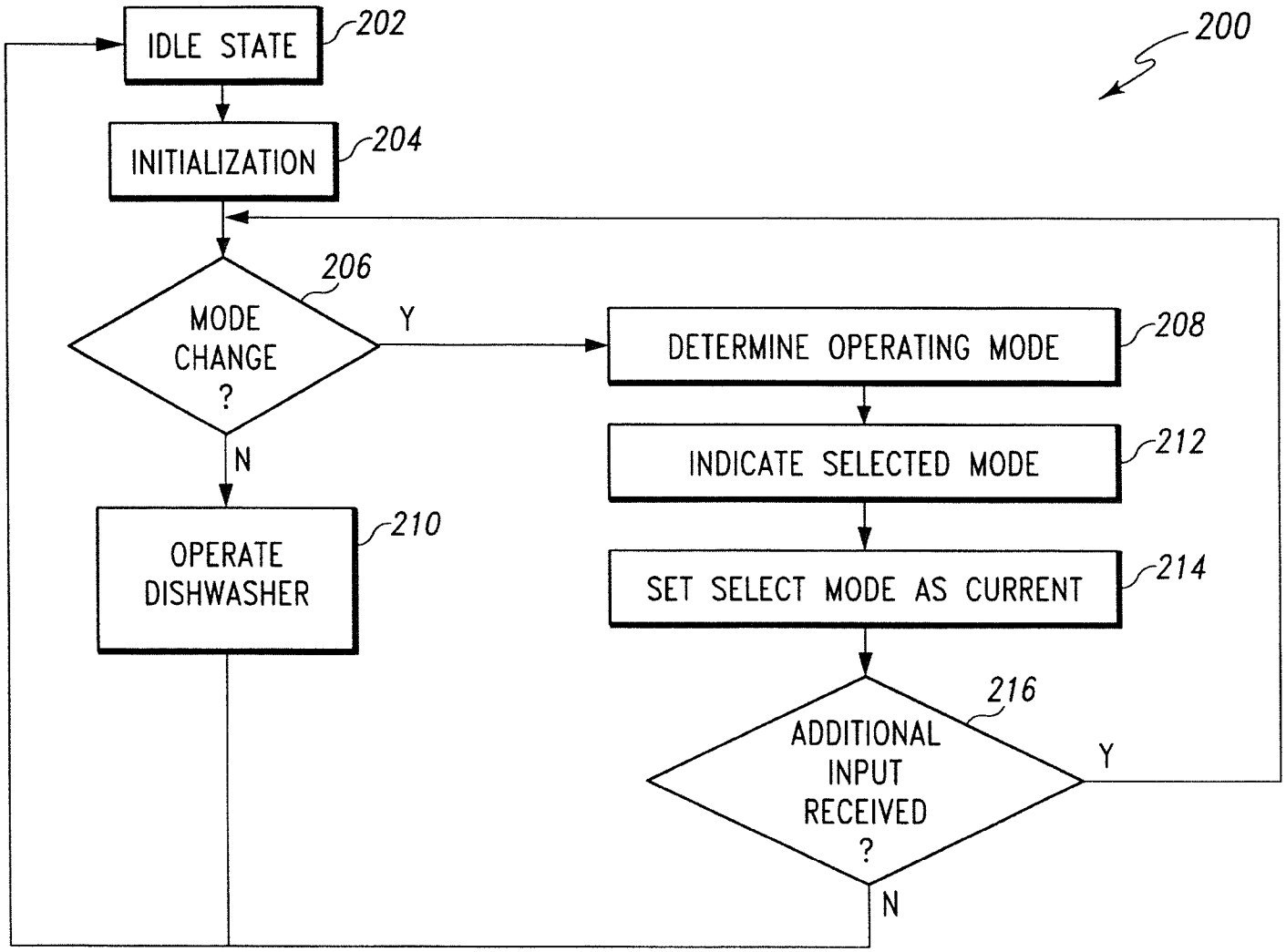
FIG. 3 is a simplified flow chart of an illustrative control routine for operating the dishwashing machine of FIG. 1.

Referring now to FIG. 3, a simplified block diagram illustrates a control routine 200 for operating the dishwasher 10. When the user first accesses the control panel 28, the dishwasher 10 is in an idle state (step 202). The controller 100 then executes an initialization step 204 in which the controller 100 determines the current operating mode. Accessing the memory device 104, the controller 100 identifies the last operating mode that was active when the dishwasher 10 entered the idle state. The controller 100 then sets the current operating mode equal to the last operating mode. At the completion of the initialization step 204, the controller 100 is ready to operate the dishwasher 10.

The routine 200 advances to step 206 when the controller 100 receives a user-input signal from the control panel 28. As discussed above, when the user presses any of the controls 30 located on the control panel 28, a control switch coupled to the control switch generates an electrical output signal indicative of the user-input. In step 206, the controller 100 determines whether user-input is a mode change. To do this, the controller 100 compares the user-input (or sequence of user-inputs) to a look-up table stored in the memory device 104. If the user-input corresponds to a mode change entry in the look-up table, the controller 100 determines that the user-input is a mode change and the user has indicated a desire to change the operating mode of the dishwasher 10.

For example, one mode change entry in the look-up table might require the user to press the control button labeled "Normal Wash" for more than thirty seconds. If the user simply presses and releases the "Normal Wash" button, the controller 100 accesses the look-up table and determines the user-input does not match a mode change entry. If, however, the user presses and holds the "Normal Wash" button for more than thirty seconds, the controller 100 determines the user-input is a mode change. When the controller 100 determines the user-input is a mode change, the routine 200 advances to step 208. When the controller 100 determines the user has not entered a mode change, the routine 200 advances to step 210.

In step 208, the controller 100 determines the new operating mode based on the user-input received in step 206. Again accessing the look-up table stored in the memory device 104, the controller 100 selects the operating mode corresponding to the user-input. The new operating mode may be one of a plurality of hidden operating modes or the factory-default operating mode. For example, the mode entry in the look-up table corresponding to pressing and holding the "Normal Wash" button for more than thirty seconds might be a hard water operating mode. In that case, when the user presses that the "Normal Wash" button for more than thirty seconds, the controller 100 selects the hard water operating mode. Alternatively, the mode entry in the look-up table corresponding to pressing the "Normal Wash" button four times in quick succession might be the factory-default operating mode. When the user quickly presses the "Normal Wash" button four times in succession, the controller 100 selects the factory-default operating mode. After selecting the operating mode corresponding to the user-input, the routine advances to step 212.

In step 212, the controller 100 activates the number of light emitting diodes 32 in a sequence indicative of the selected operating mode. Each sequence of light emitting diodes 32 is indicative of a different and unique operating mode. In that way, the user can confirm the controller 100 selected the operating mode desired by the user. For example, if the selected operating mode is the hard water operating mode, the controller 100 may activate only one of the light emitting diodes 32. Similarly, the controller 100 might flash all of the light emitting diodes 32 rapidly when the selected operating mode is the factory-default operating mode. It will be appreciated that in other embodiments the dishwasher 10 may provide an indication of the selected operating mode by emitting sounds or activating backlighting of the individual buttons. When the controller 100 has completed step 212, the routine 200 advances to step 214.

In step 214, the controller 100 sets the selected operating mode as the current operating mode, thereby activating the selected operating mode in the dishwasher 10. In other words, the controller 100 replaces the operating mode determined in step 204 with the operating mode selected in step 210. The controller 100 then saves the new current operating mode in the memory device 104. When the controller 100 has completed step 214, the routine 200 advances to step 216.

In step 216, the controller 100 determines whether another user-input signal has been received from the control panel 28. When the controller 100 receives another user-input signal, the routine 200 returns to step 206 to identify the user-input signal. When a user-input signal is not received within a predefined period, the routine 200 returns to step 202 and places the dishwasher 10 in the idle state until the user accesses the control panel 28. In other embodiments, step 216 may be eliminated such that the routine 200 advances directly to step 202 when the controller 100 has completed step 214.

Returning to step 206, when the controller 100 determines the user-input is not a mode selection, the routine 200 advances to step 210. In step 210, the controller 100 operates the dishwasher 10 in accordance with the current operating mode. The controller 100 first selects a look-up table associated with the current operating mode from a plurality of look-up tables stored in the memory device 104. Each of the plurality of look-up tables contains a plurality of dishwashing cycles corresponding to user-inputs received from the control panel 28. Each of the dishwashing cycles has a number of operational parameters, which govern the operation of dishwasher 10 when the dishwashing cycle is active. Using the particular look-up table associated with the current operating mode, the electronic controller 100 selects the dishwashing cycle corresponding to the user-input received in step 202. The controller 100 then operates the dishwasher 10 in accordance with the selected dishwashing cycle.

As described above, a dishwashing cycle includes at least a washing stage (i.e., the main washing stage), in which a detergent chemistry containing water and a detergent is applied to the dish racks 16, and a rinsing stage, in which a rinse chemistry containing water and a rinse aid is applied to the dish racks 16. During the dishwashing cycle, the inlet valve 44 is selectively operated to supply fluid to the tub 12 at the beginning of a particular stage and the drain pump 56 is selectively operated to drain fluid at the end of a particular stage. The electric heating element 76 is also selectively operated to increase the temperature in the washing chamber 14 to heat the fluid in the sump 50 when fluid is present in the sump 50 or dry the wares positioned on the dish racks 16.

Throughout the performance of the selected dishwashing cycle, the controller 100 communicates with the turbidity sensor 80, the temperature sensor 86, and any other sensor, and the measurements taken by those sensors are recorded in the memory device 104. As described above, the electronic controller 100 uses those measurements to control the operation of dishwasher 10. When the dishwasher 10 has completed the dishwashing cycle, the routine 200 returns to step 202 and places the dishwasher 10 in the idle state until the user accesses the control panel 28.

Figure 4:
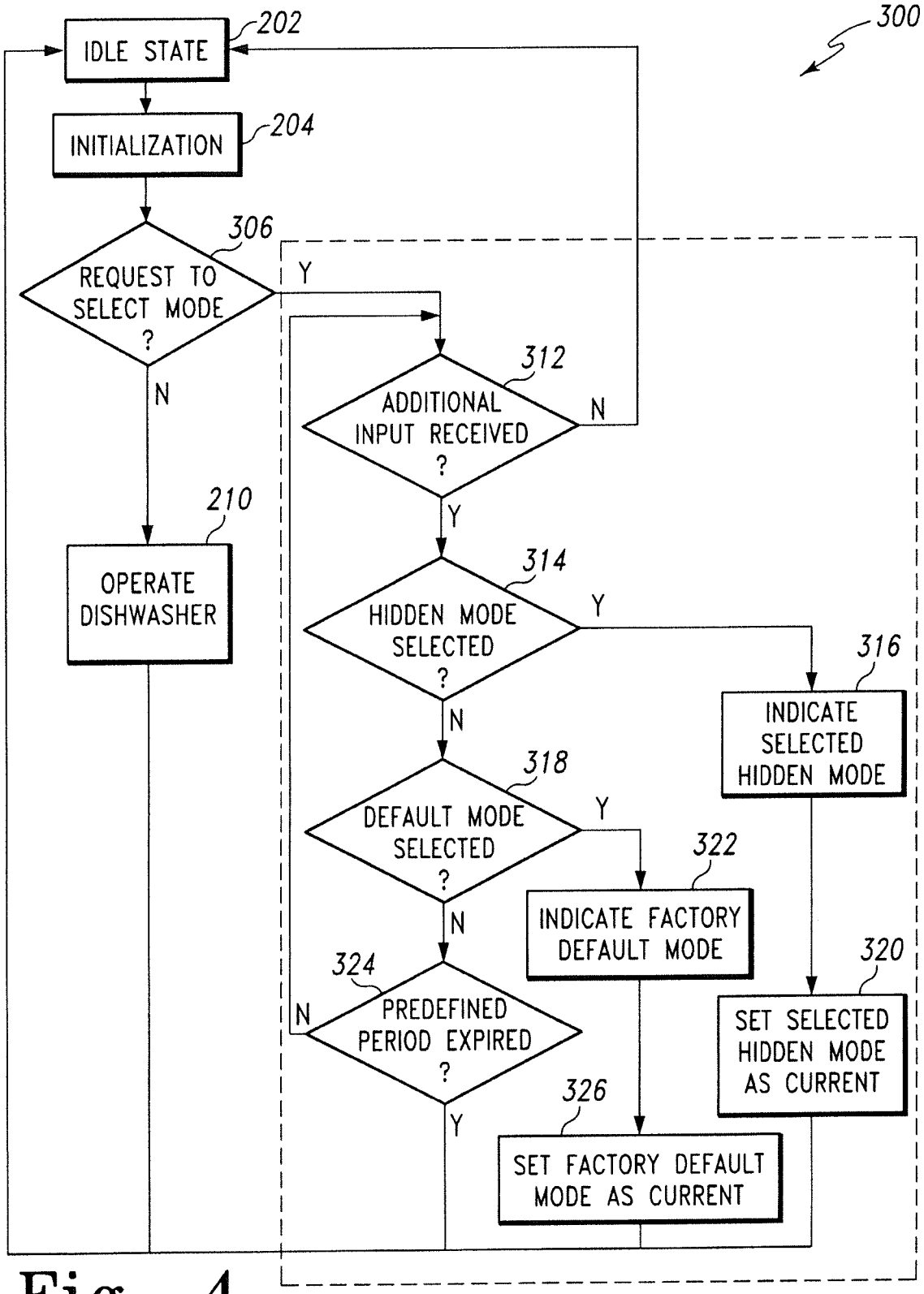
FIG. 4 is a simplified flow chart of another embodiment of a control routine for operating the dishwashing machine of FIG. 1.

Referring now to FIG. 4, another embodiment of a control routine (hereinafter routine 300) for operating the dishwasher 10 is shown. Some of the steps of the routine 300 are substantially similar to those discussed above in reference to the embodiments of FIG. 3. Such steps are designated in FIG. 4 with the same reference numbers as those used in FIG. 3. When the user first accesses the control panel 28, the dishwasher 10 is in the idle state (step 202). The controller 100 then executes the initialization step 204 in which the controller 100 sets the current operating mode. At the completion of the initialization step 204, the controller 100 is ready to operate the dishwasher 10, and the routine 300 advances to step 306 when the controller 100 receives a user-input signal from the control panel 28.

In step 306, the controller 100 determines whether the user-input is a request to select a new operating mode. The memory device 104 has stored therein a specific user-input sequence that, when entered by the user, indicates a request to select a new operating mode. For example, the specific user-input might be pressing the "Start" control button for more than thirty seconds. If the user presses and holds the "Start" button for more than thirty seconds, the controller 100 determines the user has entered the mode selection request. When the user-input is the mode selection request, the controller 100 activates a mode selection sub-routine 310, which includes steps 312-326. When the user-input is not the mode selection request, the routine 300 proceeds to step 210.

Upon activation of the sub-routine 310, the routine 300 advances to step 312. In step 312, the controller 100 activates the number of light emitting diodes 32 in a sequence that indicates the mode selection sub-routine 310 is active. In that way, the user can confirm the controller 100 entered the mode selection sub-routine 310 as desired.

The controller 100 also determines in step 312 whether an additional user-input signal has been received from the control panel 28. When the controller 100 receives the additional user-input signal, the sub-routine 310 advances to step 314. When the additional user-input signal is not received within a predefined period, the sub-routine 310 ends, and the routine 300 returns to step 202, thereby placing the dishwasher 10 in the idle state until the user accesses the control panel 28.

In step 314, the controller 100 determines whether the additional user-input(s) indicates that a hidden operating mode has been selected. The controller 100 compares the additional user-input or sequence of user-inputs to a look-up table stored in the memory device 104. When the user-input is equal to an entry in the look-up table corresponding to a hidden operating mode, the controller 100 selects the hidden operating mode, and the sub-routine advances to step 316. When the user-input does not correspond to a hidden operating mode, the sub-routine advances to step 318.

In step 316, the controller 100 activates the number of light emitting diodes 32 in a sequence indicative of the selected hidden operating mode. Each sequence of light emitting diodes 32 is indicative of a different and unique hidden operating mode. In that way, the user can confirm the controller 100 selected the hidden operating mode desired by the user. When the controller 100 has completed step 316, the routine 200 advances to step 320.

In step 320, the controller 100 sets the selected hidden operating mode as the current operating mode and thereby activates the selected hidden operating mode in the dishwasher 10. In other words, the controller 100 replaces the operating mode determined in step 204 with the hidden operating mode selected in step 314. The controller 100 then saves the new current operating mode in the memory device 104. When the controller 100 has completed step 320, the sub-routine 310 ends. The routine 300 then returns to step 202, thereby placing the dishwasher 10 in the idle state until the user accesses the control panel 28.

Returning to step 314, when the user-input does not correspond to a hidden operating mode, the sub-routine advances to step 318. In step 318, the controller 100 determines whether the additional user-input(s) indicates that the factory-default operating mode has been selected. The memory device 104 has stored therein a specific user-input sequence that, when entered by the user, indicates the factory-default operating mode has been selected. When the additional user-input(s) matches the specific user-input sequence corresponding to the factory-default operating mode, the controller 100 selects the factory-default operating mode, and the sub-routine advances to step 322. When the controller 100 determines the factory-default operating mode has not been selected, the sub-routine advances to step 324.

In step 322, the controller 100 activates the number of light emitting diodes 32 in a sequence indicative of the factory-default operating mode. In that way, the user can confirm the controller 100 selected the factory-default operating mode. When the controller 100 has completed step 322, the routine 200 advances to step 326.

In step 326, the controller 100 sets the factory-default operating mode as the current operating mode and thereby activates the factory-default operating mode in the dishwasher 10. The controller 100 then saves the new current operating mode in the memory device 104. When the controller 100 has completed step 326, the sub-routine 310 ends, and the routine 300 returns to step 202, thereby placing the dishwasher 10 in the idle state until the user accesses the control panel 28.

Returning to step 318, when the controller 100 determines the factory-default operating mode has not been selected, the sub-routine advances to step 324. In step 324, the controller 100 determines whether a predefined period of time has elapsed since the controller 100 activated the sub-routine 310. If the predefined period has not expired, the sub-routine 310 returns to step 312 to determine if an additional user-input has been received. If the user does not successfully select an operating mode before the predefined period expires, the sub-routine 310 ends, and the routine 300 returns to step 202, thereby placing the dishwasher 10 in the idle state until the user accesses the control panel 28.

Returning to step 306, when the controller 100 determines the user-input is not a mode selection, and the routine 300 advances to step 210. In step 210, the controller 100 operates the dishwasher 10 in accordance with the current operating mode. The controller 100 first selects a look-up table associated with the current operating mode from a plurality of look-up tables stored in the memory device 104. Using the particular look-up table associated with the current operating mode, the electronic controller 100 selects the dishwashing cycle corresponding to the user-input received in step 202. The controller 100 then operates the dishwasher 10 in accordance with the selected dishwashing cycle.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A method of operating a dishwasher having a washing chamber, a number of dish racks positioned in the washing chamber, a pump operable to circulate fluid onto the number of dish racks, a user interface operable to receive user input and generate electrical output signals indicative thereof, wherein the user interface includes a number of control switches, and an electronic controller electrically coupled to the pump and the user interface, the controller comprising (i) a processor, and (ii) a memory device electrically coupled to the processor, the memory device having stored therein the plurality of default washing cycles, the plurality of hidden washing cycles and a plurality of instructions, and a default operating mode in which the dishwasher can be selectively operated in one of the plurality of pre-programmed default dishwashing cycles through actuation of at least one control switch, comprising:

receiving a user-input signal indicative of a desire to access a hidden operating mode distinct from the default operating mode, entering the hidden operating mode of the dishwasher based on the user-input signal, actuating the at least one control switch to select one of the plurality of pre-programmed hidden dishwashing cycles associated with the hidden operating mode, and operating the dishwasher in the hidden operating mode in accordance with the one of the plurality of pre-programmed hidden dishwashing cycles, wherein the plurality of pre-programmed hidden dishwashing cycles associated with the hidden operating mode are optimized to specific environmental conditions and directly based on water hardness, by changing a cycle temperature.

2. The method of claim 1, wherein the user-input signal is indicative of a sequence of user inputs received via a user interface panel.

3. The method of claim 1, further comprising indicating the hidden operating mode on an external panel of the dishwasher.

4. The method of claim 3, wherein indicating the hidden operating mode includes activating a number of light emitting diodes in a customized sequence indicative of the hidden operating mode.

5. The method of claim 1, further comprising:

selecting the default operating mode based on a second user-input signal, wherein the second user-input signal is generated by the actuation of the at least one control switch of the dishwasher and a labeled function of the at least one control switch is not the default operating mode; and accessing a plurality of pre-programmed dishwashing cycles associated with the default operating mode.

6. The method of claim 1, further comprising:

receiving a second user-input signal indicative of a desire to access a second hidden operating mode, entering the second hidden operating mode of the dishwasher based on the second user-input signal, actuating the at least one control switch to select one of a second plurality of pre-programmed hidden dishwashing cycles associated with the second hidden operating mode, and operating the dishwasher in the second hidden operating mode in accordance with the one of the second plurality of pre-programmed hidden dishwashing cycles, wherein the plurality of pre-programmed hidden dishwashing cycles associated with the hidden operating mode are optimized for cold water in a water source line.

7. The method of claim 1, wherein the at least one of the specific environmental conditions is the use of detergent gels and various types of liquid or gel rinse aid.

8. A method of operating a dishwasher having a washing chamber, a number of dish racks positioned in the washing chamber, a pump operable to circulate fluid onto the number of dish racks, a user interface operable to receive user input and generate electrical output signals indicative thereof, wherein the user interface includes a number of control switches required to select one of a plurality of default washing cycles when the dishwasher is in a default operating mode or one of a plurality of hidden washing cycles when the dishwasher is in a hidden operating mode, and an electronic controller electrically coupled to the pump and the user interface, the controller comprising (i) a processor, and (ii) a memory device electrically coupled to the processor, the memory device having stored therein the plurality of default washing cycles, the plurality of hidden washing cycles and a plurality of instructions, said method comprising:

operating the dishwasher in a default operating mode in accordance with one of the plurality of pre-programmed default dishwashing cycles based on actuation of at least one control switch of the dishwasher, initiating a mode selection sub-routine based on a first user-input signal, receiving a second user-input signal indicative of a hidden operating mode, entering the hidden operating mode based on the second user-input signal, and operating the dishwasher in the hidden operating mode in accordance with one of the plurality of pre-programmed hidden dishwashing cycles associated with the hidden operating mode by actuating the at least one control switch of the dishwasher, the one of the plurality of pre-programmed hidden dishwashing cycles being optimized, directly based on water hardness, by changing a cycle temperature.

9. The method of claim 8, wherein the one of the plurality of pre-programmed hidden dishwashing cycles is optimized for a variety of water hardnesses.

10. The method of claim 8, wherein initiating the mode selection sub-routine includes indicating an activation of the sub-routine on an external panel of the dishwasher.

11. The method of claim 8, further comprising deactivating the mode selection sub-routine when the second user-input signal is not received in a predefined period of time.

12. The method of claim 8, further comprising:

receiving a third user-input signal indicative of a second hidden operating mode, entering the second hidden operating mode based on the third user-input signal, and operating the dishwasher in the second hidden operating mode in accordance with one of a second plurality of pre-programmed hidden dishwashing cycles associated with the second hidden operating mode by actuating the at least one control switch of the dishwasher, the one of the plurality of pre-programmed hidden dishwashing cycles being optimized for cold water in a water source line or the use of at least one of detergent tablets, detergent gels and various types of rinse aid.

13. A dishwasher comprising:

a washing chamber, a number of dish racks positioned in the washing chamber, a pump operable to circulate fluid onto the number of dish racks, a user interface operable to receive user input and generate electrical output signals indicative thereof, wherein the user interface includes a number of control switches required to select one of a plurality of default washing cycles when the dishwasher is in a default operating mode or one of a plurality of hidden washing cycles when the dishwasher is in a hidden operating mode, wherein the plurality of pre-programmed dishwashing cycles associated with the hidden operating mode are optimized, directly based on water hardness, by changing a cycle temperature, and an electronic controller electrically coupled to the pump and the user interface, the controller comprising (i) a processor, and (ii) a memory device electrically coupled to the processor, the memory device having stored therein the plurality of default washing cycles, the plurality of hidden washing cycles and a plurality of instructions which, when executed by the processor, cause the processor to:

(a) activate the hidden operating mode of the dishwasher based on the electrical output signal generated by the user interface, and (b) operate the dishwasher in accordance with the hidden operating mode and actuation of the number of control switches.

14. The dishwasher of claim 13, wherein the plurality of pre-programmed dishwashing cycles associated with the hidden operating mode are optimized for a variety of water hardnesses.

15. The dishwasher of claim 13, wherein the control switches are also used to select one of a second plurality of hidden washing cycles, associated with a second hidden operating mode, the second plurality of hidden washing cycles being optimized for cold water in a water source line or the use of detergent tablets, detergent gels and various types of rinse aid.

16. The dishwasher of claim 13, wherein the number of control switches is electrically coupled to the electronic controller, the number of control switches being operable to generate electrical output signals indicative of a sequence of user inputs, and the plurality of instructions, when executed by the processor, further cause the processor to receive the electrical output signals and select the hidden operating mode corresponding to the sequence of user inputs.

17. The dishwasher of claim 16, wherein each control switch of the number of control switches is coupled to a control button located on the user interface.

18. The dishwasher of claim 16, wherein the plurality of instructions, when executed by the processor, further cause the processor to:

(a) receive the electrical output signals generated by the number of control switches and select the default operating mode corresponding to a sequence of user inputs, a labeled function of the number of control switches is not the default operating mode, and (b) operate the dishwasher in accordance with the default operating mode.

19. The dishwasher of claim 16, wherein:

the user interface includes a number of light emitting diodes electrically coupled to the processor, and the plurality of instructions, when executed by the processor, further cause the processor to activate the light emitting diodes in a sequence indicative of the hidden operating mode.

20. The dishwasher of claim 16, wherein:

one of the number of control switches is associated with one of the plurality of default washing cycles or hidden washing cycles selected from the group consisting of a normal wash, a heavy duty wash, and a light wash.

* * * * *